United States Patent [19]

Lindblad

[11] 4,025,992

[45] May 31, 1977

[54] DEVICE FOR SAFETY BELTS FOR VEHICLES

[76] Inventor: Oskar Lennart Lindblad, Hedasgatan 16, 440 20 Vargarda, Sweden

[22] Filed: Jan. 8, 1976

[21] Appl. No.: 647,517

[30] Foreign Application Priority Data

Jan. 10, 1975 Sweden ..... 7500248

[52] U.S. Cl. ..... 24/230 AL

[51] Int. Cl.[2] ..... A44B 11/26

[58] Field of Search ..... 24/230 AL, 230 AN

[56] References Cited

UNITED STATES PATENTS

| | | | |
|---|---|---|---|
| 3,555,632 | 1/1971 | Lindblad | 24/230 AL |
| 3,587,141 | 4/1969 | Brown | 24/205.17 |
| 3,763,523 | 10/1973 | Lindblad | 24/230 AL |
| 3,789,492 | 2/1974 | Klink | 24/230 AL |

FOREIGN PATENTS OR APPLICATIONS

| | | | |
|---|---|---|---|
| 110,999 | 4/1967 | Norway | 24/230 AL |

*Primary Examiner*—Bernard A. Gelak

[57] ABSTRACT

A receiving part for the coupling tongue of a vehicle safety belt with two spaced guides plates, a locking body for locking the tongue within the guide plate and being movable in a direction transverse to the guide plate, a lever-shaped lifting element located in the receiving part and cooperating with the locking body and being passed thereagainst by a spring. The lifting element has a projection with an oblique surface located in the path of insertion of the coupling tongue in front of the locking body so that upon insertion of the tongue into the receiving part the tongue lifts the oblique surface and projection and thereby the locking body against the spring out of the path of insertion of the coupling tongue.

10 Claims, 6 Drawing Figures

DEVICE FOR SAFETY BELTS FOR VEHICLES

The present invention relates to a receiving part intended to form part of the coupling means of a safety belt for vehicles.

It is a principal object of the invention to provide a device of the kind mentioned, which is of simple design, simple to mount, and in connection with which the locking body is relieved from stress with respect to forces, which are caused at right angle to its direction of movement by the coupling tongue in connection with its introduction, which makes the locking body reliable in function for a long time, as on account of the design according to the invention the guides of the locking body will be subjected to very little wear, and the risk of these guides being seized up is practically eliminated.

This object is reached by means of a receiving part with the characteristics indicated in the following description.

Figure 1:
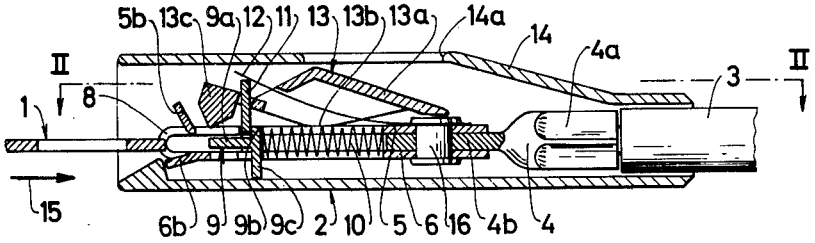
Figure 2:
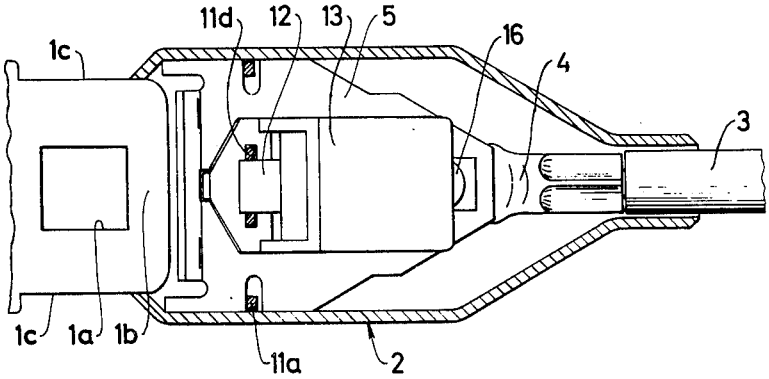
Figure 3:
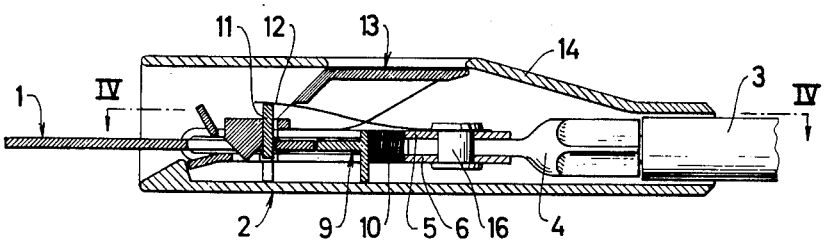
Figure 4:
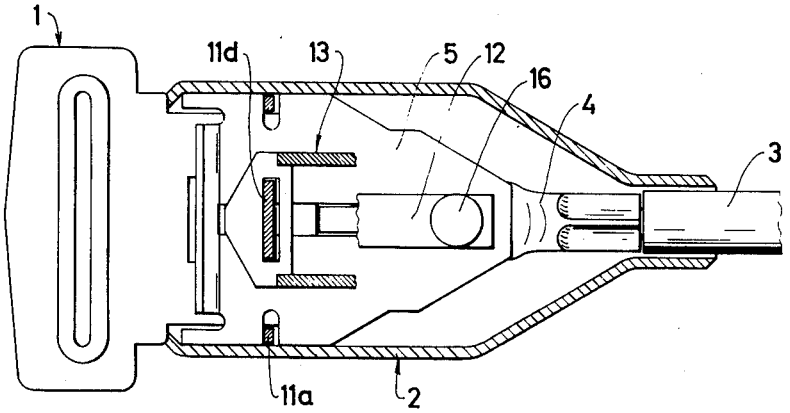
Figure 5:
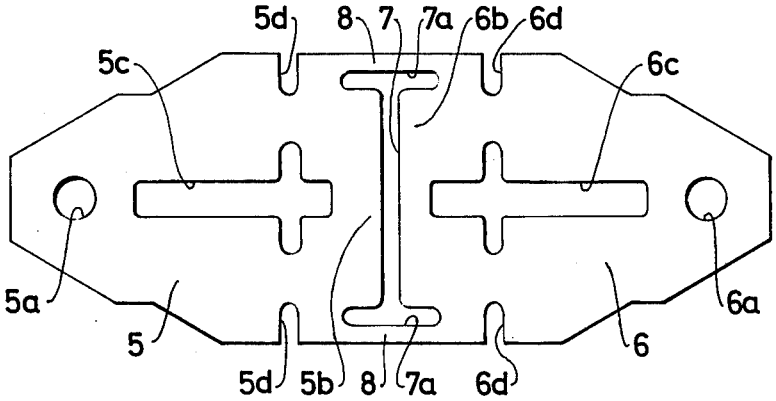
Figure 6:
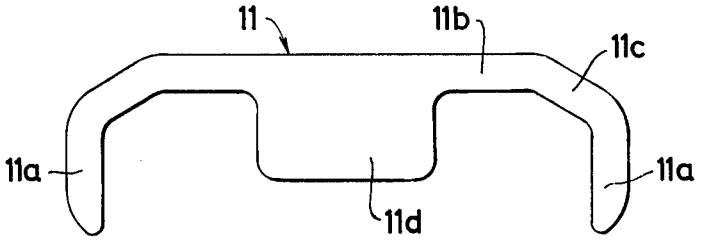

In the following an example of an embodiment of the object of the invention will be described, reference being made to the accompanying drawings, in which FIG. 1 is a longitudinal cross sectional view of a coupling means equipped with a receiving part according to the invention, said coupling means being in inactive condition, i.e. not being coupled together with a coupling tongue provided on the safety belt, said coupling tongue, however, being shown in a partially inserted position in the opening of introduction of the receiving part, FIG. 2 is a cross sectional view along the line II — II of FIG. 1., FIG. 3 is a cross sectional view corresponding the one in FIG. 1, but with the device in working condition, i.e., coupled together with the coupling tongue in question, FIG. 4 is a cross sectional view along the line IV — IV of FIG. 3., FIG. 5 illustrates a detail forming part of the device, and FIG. 6 shows an additional detail forming part of the same device.

In the drawings a coupling tongue in a manner not shown is mounted preferably in a sliding manner on the band of the safety belt for a vehicle. The coupling tongue 1 can be inserted into and be coupled together with a receiving part, in its entirety indicated with 2, which preferably is anchored in the body of the vehicle by means of a wire 3 or similar means. A portion 4*a* of tubular shape of a ferrule 4 is clamped on the terminal of the wire 3, the other end portion of the ferrule being flattened and exhibiting a thickness, which somewhat exceeds the thickness of the coupling tongue 1 and forms a spacer element between two guiding plates 5, 6 located at a distance from each other. The lateral surfaces of said plates face each other shaping the guide for the coupling tongue 1 in connection with its insertion into the receiving part. The two guiding plates 5, 6 are attached to the portion 4*b* of the ferrule 4 by means of a through rivet 16. In the embodiment shown the two guiding plates 5 and 6 are stamped as an integral piece from a single bank of sheet metal, the stamped out piece being illustrated in FIG. 5. In the embodiment shown the stamping is provided with two symmetrical halves, the bores through which the rivet 16 in mounted condition is drawn being indicated with 5a and 6a respectively. The two halves are defined by an H-shaped slit 7, the transverse bar of which extends over the greater part of the width of the plate, the comparatively short vertical legs 7*a* preferably being located near the lateral edges of the plate, and the outer defining edges of the widened end portions 7*a* of the slit being located at a distance from each other, which somewhat exceeds the width of the coupling tongue 1. In mounted condition the two halves 5 and 6 are folded along a line through the center of the slit 7, the bridge shaped portions 8 connecting the two halves being bent in curved shape and in mounted condition of the device thus forming spacer organs, located at the opening of introduction of the receiving part, for the two guide plates 5 and 6. In mounted condition the tongue shaped portions 5*b* and 6*b* respectively bordering upon the slit 7 are folded up in a direction away from each other, as is best illustrated in the FIG. 1 and 3. An ejector 9 has a portion 9*a* extending in the longitudinal direction of the two guide plates 5 and 6, the thickness of said portion 9*a* being somewhat smaller than the distance between the two guide plates, and two portions 9*b* and 9*c* respectively extending in transverse direction to the plane of the two guide plates, said portions 9*b* and 9*c* exhibiting a width somewhat smaller than the width of the longitudinal slits 5*c* and 6*c* respectively made in the two guide plates, which last mentioned slits thus form a guide for the ejector 9. A compression spring 10 is inserted between the end of the ferrule 4 and the ejector 9, which spring tends to displace the ejector to the position illustrated in FIG. 1. A locking body in its entirety indicated with 11 and forming part of the device is likewise stamped out of a sheet metal blank in order substantially to be given a U-shape, as is shown in FIG. 6. The portions forming two staples of the locking body are indicated with 11*a*, the intermediate portion of the locking body is indicated with 11*b*, and a portion connecting the portion 11*b* and the end portions 11*a* is indicated with 11*c*, which portion preferably but not necessarily needs to have the shape illustrated in FIG. 6. This portion can of course also be of curved shape. A central portion 11*d* converted to the intermediate portion 11*b* forms the portion of the locking body cooperating with the locking tongue. As is best evident from the FIGS. 2 and 4 the portions 11*a* of the locking body in mounted condition are displaceably guided in the guide slits 5*d* and 6*d* respectively, which are made in the two guide plates 4 and 6 and are open in lateral direction. The guide portions 11*a* are so much longer than the tongue shaped projection 11*d* that they maintain their engagement with the two guide plates 5 and 6 also in the position, which is illustrated in FIG. 1, i.e., when the portion 11*d* of the locking body is lifted up so far away from the guide plate 6 that the coupling tongue can be moved past the locking body. Due to the fact that the guiding organs 11*a* thus are fully guided also in this position, it is effectively prevented that the locking body occupy an oblique position, which could make the return to the locking position unreliable. The illustrated design of the locking body is especially suitable in cases, in which the locking tongue has a locking opening 1*a*, which is closed at the front, in which case the bridge shaped portion 1*b* defining the opening at the front must be able to pass below the locking body. The guide slits 5*c* and 6*c* respectively of the ejector 9 have widened portions right in front of the slits 5*d* and 6*d* respectively, intended to receive the portion 11*d* of the locking body. In the condition of the coupling means illustrated in FIG. 1 the ejector 9 has been displaced by the spring 11 into its outer position, in which its portion 9*a* extends past the portion 11*d* of the locking body, in which condition its guide portion 9*b* abuts against the locking body 11, which in spite of the bias of a plate spring 12, stretched between the rivet 16 and the body 11 itself, is prevented from returning to the locking position illustrated in FIG. 3, unless the ejector 9 previously has been moved backwards. A Z-shaped operating bar is in its entirety indicated with 13, one lever arm of this bar being accessible through an operating opening 14*a* made in a housing 14 surrounding the mechanism, the other lever arm being moved below the portions 11*d* of the locking body 11, so that said operating bar, when the lever arm 13*a* is pressed in in connection with a pivoting movement about a curved edge portion 13*b* with its other lever arm 13*c* lifts up the locking body against the bias of the spring 12. The lever arm 13*c* provided with a portion, located outside of the locking body, and in the locking position of the same projects downwards through the slit 5*c*, said portion being provided with a wedge shaped front surface in order to make possible the insertion of the tongue 1 also in case the locking body should have fallen down to a locking position in front of the ejector 9. In connection with the coupling together the locking tongue is inserted in the direction marked with the arrow 15 in FIG. 1, the ejector 9 being displaced against the bias of the spring 10, until the locking body 11 with its portion 11*b* falls down in the opening 1*a* of the locking tongue 1 by actuation of the spring 12, i.e. to the position illustrated in FIG. 3. In this position the lever arm 13 has been pivoted in counter clock-wise direction about its edge portion 13*b*. In connection with the disengagement the portion of the lever arm 13 located inside the operating opening 14*a* is pressed down, the edge portion 13*b* rolling towards the guide plate 5, which means that during the first part of the lifting movement of the locking body 11 one obtains a comparatively strong force, i.e. during the part of the movement, when the friction between the locking body and the locking tongue is greatest, while instead the path of movement of the locking body relative to the movement of the lever arm 13 increases the more the same is lifted up. Among other things this brings in turn the advantage that the receiving part can be made comparatively thin, i.e. one has succeeded in obtaining a comparatively long way of movement of the locking body relative to the way of movement of the lever arm 13*a* on account of the contact point, where the arm bears against the plate 5, being displaced as a result of the curvature of the edge portion 13*b*.

The invention is not limited to the embodiment described above and illustrated in the drawings by way of example only, but can be varied as to its details within the scope of the following claims without therefore departing from the fundamental idea of the invention.

I claim:

1. A receiving part for the coupling tongue of a safety belt for vehicles, comprising: spaced guide means for receiving said tongue therebetween, locking means for locking said tongue within said guide means when said tongue is received therebetween, said locking means being movable in said receiving part in a direction transverse to said guide means and to the direction of insertion of said tongue into said receiving part, a lever-shaped lifting element located in said receiving part and cooperating with, but being separate from, said locking means, spring means pressing said locking means against said lifting element, said lifting element having a projection with an oblique surface located in the path of insertion of said coupling tongue in front of said locking means when looking in the direction of insertion of said tongue into said receiving part, so that upon insertion of said tongue into said receiving part, said tongue lifts said oblique surface and projection and thereby said locking means out of the path of insertion of said coupling tongue against said spring means.

2. A receiving part according to claim 1, wherein said spring means is a plate spring, one end portion of which is attached to one of said guide means, the other end of said plate spring bearing against said locking means, which in turn holds said lifting element in a clamped position between said locking means and one of said guide means.

3. A receiving part according to claim 2, wherein said locking means and said lifting element are positively guided with respect to their positions relative to each other and relative to said guide means in the plane of said guide means, but are removable at a right angle to said plane after said spring means has been moved aside.

4. A receiving part according to claim 1, wherein said locking means has at least one guiding portion extending through said guide means in a direction transverse thereto and exceeding in length at least the thickness of said coupling tongue so as to maintain the engagement of said guiding portion with said guiding means even when said locking means is entirely lifted out of said coupling tongue, said guiding portion being located laterally outside the longitudinal edge of said coupling tongue.

5. A receiving part according to claim 4, wherein said guiding means of said locking means are located in close proximity to the longitudinal edges of said coupling tongue, thereby forming a sidewise guiding means for said coupling tongue.

6. A receiving part according to claim 4, wherein said locking means including its guiding portion forms one piece of sheet metal.

7. A receiving part according to claim 6, wherein said locking means is a substantially U-shaped piece, said guide portions forming the legs of said U-shaped piece and the portion of the U-shaped piece connecting said legs forming the portion which engages said coupling tongue.

8. A receiving part according to claim 4, wherein said guiding portions of said locking means extend through slit-shaped openings in lateral edges of said guide means.

9. A receiving part according to claim 1, which comprises an ejector, spring means biasing said ejector in a direction opposite to the direction of insertion of said coupling tongue and having a portion movable in the space between said guide means, said ejector portion pushing said tongue out of said receiving part, when said locking means has been lifted from its locking position, said ejector having an extension extending unto and below said locking means when the latter is in its lifted position to thereby prevent the same from returning to the locking position, when said coupling tongue is disengaged.

10. A receiving part according to claim 9, wherein said locking means forms a stop, stop means provided on said ejector and cooperating with said stop for limiting the movement of said ejector in a direction opposite the direction of insertion of said coupling tongue.

* * * * *